US007196271B2

(12) United States Patent
Cornibert et al.

(10) Patent No.: US 7,196,271 B2
(45) Date of Patent: Mar. 27, 2007

(54) TWISTED PAIR CABLE WITH CABLE SEPARATOR

(75) Inventors: Jacques Cornibert, Verdun (CA); Jorg-Hein Walling, Beaconsfield (CA); Christian Yameogo, Montreal (CA)

(73) Assignee: Belden CDT (Canada) Inc., Toronto (CA)

( * ) Notice: Subject to any disclaimer, the term of this patent is extended or adjusted under 35 U.S.C. 154(b) by 0 days.

(21) Appl. No.: 10/378,398

(22) Filed: Mar. 3, 2003

(65) Prior Publication Data

US 2004/0055781 A1 Mar. 25, 2004

Related U.S. Application Data

(60) Provisional application No. 60/364,158, filed on Mar. 13, 2002.

(51) Int. Cl.
*H01B 11/00* (2006.01)

(52) U.S. Cl. ..... 174/113 C

(58) Field of Classification Search ..... 174/113 R, 174/113 C, 131 A; 385/103, 110, 113
See application file for complete search history.

(56) References Cited

U.S. PATENT DOCUMENTS 3,363,047 A * 1/1968 Grove ..... 174/15.7
3,819,443 A 6/1974 Simons et al.
5,132,488 A 7/1992 Tessier et al.
5,671,313 A * 9/1997 Schneider et al. ..... 385/110
5,789,711 A 8/1998 Gaeris et al.
5,952,615 A 9/1999 Prudhon
6,288,340 B1 * 9/2001 Arnould ..... 174/113 R
6,297,454 B1 10/2001 Gareis
6,365,836 B1 4/2002 Blouin et al.
6,687,437 B1 * 2/2004 Starnes et al. ..... 385/101
6,787,697 B2 * 9/2004 Stipes et al. ..... 174/36

FOREIGN PATENT DOCUMENTS

EP 1162632 A2 12/2001
WO WO01/54142 A1 7/2001
WO WO02/073634 A2 9/2002

* cited by examiner

*Primary Examiner*—Chau N. Nguyen
(74) *Attorney, Agent, or Firm*—Lowrie, Lando & Anastasi, LLP

(57) ABSTRACT

Generally, aspects of embodiments of the invention include cable separator spline which comprises a plurality of longitudinally extending walls joined along a central axis of the spline, and a plurality of longitudinally extending channels. Each longitudinally extending channel is defined by a pair of the longitudinally extending walls, where the pair of longitudinally extending walls includes a first wall substantially thicker than a second wall. Other embodiments include a cable separator spline assembly having a plurality of longitudinally extending walls joined along a central axis of the spline, and a plurality of longitudinally extending channels. Each longitudinally extending channel is defined by a pair of the longitudinally extending walls, wherein a pair of opposing longitudinally extending walls have defined through them a common gap defining two separate sub-splines having T-shaped cross-sections. Embodiments of the invention feature various spline shapes as well as various internal structures and materials.

48 Claims, 7 Drawing Sheets

TWISTED PAIR CABLE WITH CABLE SEPARATOR

RELATED APPLICATION

This application claims the benefit under 35 U.S.C. §119 (e) of U.S. Provisional Application No. 60/364,158 filed Mar. 13, 2002, entitled "Very High Frequency Quad Pair Cable Wit Asymmetric Cross Web or Two T-Shaped Cross Webs", by Cornibert, et al. The entirety of the aforementioned application is hereby incorporated by reference.

BACKGROUND

The present invention relates to data cables employing twisted pairs of insulated conductors as the transmission medium, and to cable splines for use in the data cables.

High performance twisted pair cables have become popular for a variety of reasons. Such cables are comparatively easy to handle, install, terminate and use. They also are capable of meeting high performance standards.

Commonly, multiple twisted pairs are used in these types of cables. In each pair, the wires are twisted together in a helical fashion forming a balanced transmission line. When twisted pairs are placed in close proximity, such as in a cable, electrical energy may be transferred from one pair of the cable to another. Such energy transfer between pairs is undesirable and is referred to as crosstalk. Crosstalk causes interference to the information being transmitted through the twisted pair and can reduce the data transmission rate and can cause an increase in the bit error rate. The Telecommunications Industry Association (TIA) and Electronics Industry Association (EIA) have defined standards for crosstalk in a data communications cable such as the Category 6 cable standard ANSI/TIA/EIA-568-B.2-1, published Jun. 20, 2002 by TIA. The International Electrotechnical Commission (IEC) has also defined standards for data communications cable crosstalk, such as ISO/IEC 11801, which includes the international equivalent to ANSI/TIA/EIA-568-B.2-1.

One popular cable type meeting the above specifications is foil shielded twisted pair (FTP) cable. FTP cable is popular for local area network (LAN) applications because it has good noise immunity and a low level of radiated emissions.

Another popular cable type meeting the above specifications is unshielded twisted pair (UTP) cable. Because it does not include shield conductors, UTP cable is preferred by installers and plant managers as it is easily installed and terminated. The requirements for modern state of the art transmission systems require both FTP and UTP cables to meet very stringent requirements. Thus, FTP and UTP cables produced today have a very high degree of balance and impedance regularity. In order to achieve this balance and regularity, the manufacturing process of FTP and UTP cables may include twisters that apply a back torsion to each wire prior to the twisting operation. Therefore, FTP and UTP cables have very high impedance regularities due to the randomization of eventual eccentricities in a twisted wire pair during manufacturing.

Crosstalk is primarily capacitively coupled or inductively coupled energy passing between adjacent twisted pairs within a cable. Among the factors that determine the amount of energy coupled between the wires in adjacent twisted pairs, the center-to-center distance between the wires in the adjacent twisted pairs is very important. The center-to-center distance is defined herein to be the distance between the center of one twisted pair to the center of an adjacent twisted pair. The center of a twisted pair may be taken as the point equidistant from and on the line passing through the center of each of the individual wires in the pair. The magnitude of both capacitively coupled and inductively coupled crosstalk varies inversely with the center-to-center distance between wires, approximately following an inverse square law. Increasing the distance between twisted pairs will thus reduce the level of crosstalk interference. Another factor affecting the strength of the coupling between two twisted pairs is the medium through which the wires couple and the electromagnetic properties of that medium. Examples of these properties include conductivity, permittivity, permeability, and loss tangent. Yet another important factor relating to the level of crosstalk is the distance over which the wires run parallel to each other. Twisted pairs that have longer parallel runs will have higher levels of crosstalk occurring between them.

In twisted pairs, the twist lay length is the longitudinal distance between twists of the wire. The direction of the twist is known as the twist direction. If adjacent twisted pairs have the same twist lay length, then the coupling is longitudinally additive. In other words, the crosstalk tends to be higher between pairs having substantially the same twist lay length. In addition, cables with the same twist lay length tend to interlink. Interlinking occurs when two adjacent twisted pairs are pressed together filling any interstitial spaces between the wires comprising the twisted pairs. Interlinking will cause a decrease in the center-to-center distance between the wires in adjacent twisted pairs and can cause a periodic coupling of two or more twisted pairs. This can lead to an increase in crosstalk among the wires in adjacent twisted pairs within the cable.

Therefore, adjacent twisted pairs within a cable are given unique twist lay lengths and the same twist directions. The use of unique twist lay lengths serves to decrease the level of crosstalk between adjacent twisted pairs. However, it causes the coupling strength between each possible pair of twisted-pairs in a cable to be different.

Additionally, if each adjacent twisted pairs in cable has a unique twist lay length and/or twist direction, other problems may occur. In particular, during use mechanical stress may interlink adjacent twisted pairs.

In order to obtain yet better crosstalk performance in FTP and UTP cables, for example, to meet performance standards such as the Category 6 standard, some have introduced an interior support or spline for the data cable, such as disclosed by Gaeris et al. in U.S. Pat. No. 5,789,711, issued Aug. 4, 1998, and by Gareis in U.S. Pat. No. 6,297,454, issued Oct. 2, 2001. Additional examples of such interior support for data cables are given by Prudhon in U.S. Pat. No. 5,952,615, issued Sep. 14, 1999, and also by Blouin et al. in U.S. Pat. No. 6,365,836, issued Apr. 2, 2002. Such splines serve to separate adjacent twisted pair cables and prevent interlinking of twisted pairs.

Conventional splines have the basic cross form, such as shown in FIG. 1. These shapes have a number of disadvantages, discussed below.

The conventional cable configuration of FIG. 1 includes a cable spline 101, a plurality of twisted pairs 102 of insulated conductors 103. Cable spline 101 has walls 104 with straight, parallel sides. The entire assembly is surrounded by a jacket (not shown) and possibly by a shield (optional, not shown).

During the stranding operation, the walls 104 of cable spline 101 may be stressed and thinned, allowing the twisted pairs 102 to move tangentially to the circumference of the cable in addition to radially, away from the center of the cable. This movement is undesirable, as it causes crosstalk and attenuation variation. Due to the latter, impedance also varies, exhibiting some roughness. Variation in crosstalk over time and distance is influenced by variations in center to center distance caused by tangential displacements of the twisted pairs over time and distance. The tangential displacement varies the spacing between pairs. Radial displacement predominantly affects attenuation. Variation in radial displacement cause attenuation variation, also called attenuation roughness, as the distance from the center of each twisted pair to the jacket varies. Both of these variations also incidentally have an impact upon impedance roughness.

In conventional cables, the loss factor or loss tangent of the jacketing material also has a substantial impact upon the attenuation figure of data grade cables. Attenuation increases with proximity of the transmission media to the jacket. For this reason, data cables not having an interior support such as disclosed by Gaeris et al. generally have loose fitting jackets. The looseness of the jacket reduces the attenuation figure of the cable, but introduces other disadvantages. For example, the loose fitting jacket permits the geometric relationship between the individual twisted pairs as well as the center-to-center distance to vary, thus varying impedance and crosstalk performance.

In FTP cable, the effect of the loss tangent of the jacketing material is substantially mitigated by the shield. The shielding characteristics of the foil surrounding the twisted pairs determine the effect upon different frequencies. This shielding characteristic is best described by the transfer impedance. However, measurement of the transfer impedance is difficult, especially at higher frequencies.

The performance of shielded cable can be substantially improved by individually shielding the twisted pairs. However, such cables commonly designated as STP (Individually Shielded Twisted Pairs) wires are impractical, as they require a substantial amount of time and specialized equipment or tools for termination. Additionally, the cables themselves are relatively large in diameter due to the added bulk of the shield. Bulkier cables exhibit poor flammability performance, and also occupy more space in ducts and on cross connects than less bulky cables.

The cable spline structures disclosed by Blouin et al. in U.S. Pat. No. 6,365,836, issued Apr. 2, 2002, solves the problem of attenuation due to loss tangent by increasing the distance between the twisted pairs and the cable jacket. The cable splines disclosed by Blouin, cross sections of which are shown in FIGS. 2 and 3, feature flanged walls 201 and 301 which extend sufficiently far around the twisted pairs 202 and 302 to retain them in a stable position, but also leave a groove for the insertion of the twisted pairs during manufacture. The voids formed in the splines for holding the twisted pairs may have a variety of cross-sectional shapes, as demonstrated in FIGS. 2 and 3.

While the structure described in Blouin solves the problems associated with loss tangent and controlling attenuation variation, it is still desirable to further reduce the losses due to crosstalk between twisted pairs. One method of reducing the crosstalk between twisted pairs is described by Gareis in U.S. Pat. No. 6,297,454. FIG. 4 shows an example of the spline disclosed by Gareis. Gareis makes use of a cable separator spline 401 having four walls 402–405 of the same shape and thickness, in which two 402 and 403 walls form a pair which are separated from the remaining two walls 404 and 405 by a fifth wall or bridge 406, causing the cable to have a minor axis 407 and a major axis 408. In this way two voids are formed which are separated by a distance which is greater than the distance separating the remaining two voids. Gareis teaches that the two voids separated by the greater distance have a radius which is less than the remianing two voids. By placing the two twisted pairs with the highest crosstalk in the voids which are separated by the greatest distance, better performance can be achieved.

In addition to suffering from the previously described problems of loss tangent, the cable spline disclosed by Gareis also introduces problems due to its shape. The elliptical shape of the cable introduces difficulties in spooling the cable, and also during installation. For example, it is desirable to spool cables as tightly as possible; to spool cables tightly, it is necessary to control their position during the spooling process. This process is made difficult when the cable does not have a circular cross-section, and may require additional time or equipment. In addition, non-circular cables may require special treatment during installation or greater pull strength due to having a preferential bend axis.

Additionally, it is desirable to further improve the crosstalk properties over the cables and cable splines previously discussed.

SUMMARY

The present invention provides an improved high performance data cable and an improved data cable spline.

According to one aspect of the invention, a cable separator spline comprises a plurality of longitudinally extending walls joined along a central axis of the spline, and a plurality of longitudinally extending channels, each longitudinally extending channel defined by a pair of the longitudinally extending walls, wherein the pair of longitudinally extending walls includes a first wall substantially thicker than a second wall.

According to another aspect of the invention, a cable separator spline assembly comprises a plurality of longitudinally extending walls joined along a central axis of the spline, and a plurality of longitudinally extending channels, each longitudinally extending channel defined by a pair of the longitudinally extending walls, wherein a pair of opposing longitudinally extending walls have defined through them a common gap defining two separate sub-splines having T-shaped cross-sections.

According to yet another aspect of the invention, a high performance data cable comprises: a plurality of twisted pairs of insulated conductors; a cable separator spline having a plurality of longitudinally extending walls joined along a central axis of the spline, and a plurality of longitudinally extending channels, each longitudinally extending channel defined by a pair of the longitudinally extending walls, wherein the pair of longitudinally extending walls includes a first wall substantially thicker than a second wall.

According to yet another aspect of the invention, a high performance data cable comprises: a plurality of twisted pairs of insulated conductors and a cable separator spline assembly, which comprises a plurality of longitudinally extending walls joined along a central axis of the spline and a plurality of longitudinally extending channels, each longitudinally extending channel defined by a pair of the longitudinally extending walls, wherein a pair of opposing longitudinally extending walls have defined through them a common gap defining two separate sub-splines having T-shaped cross-sections.

According to yet another aspect of the invention, a high performance data cable comprises: a plurality of twisted pairs of insulated conductors; a jacket; a plurality of longitudinally extending walls connected to the jacket and extending substantially toward the center of the data cable;

and a plurality of longitudinally extending channels, each longitudinally extending channel defined by a pair of the longitudinally extending walls, wherein the pair of longitudinally extending walls includes a first wall substantially thicker than a second wall.

According to yet another aspect of the invention, a cable separator comprises a plurality of longitudinally extending walls, and a plurality of longitudinally extending channels, each longitudinally extending channel defined by a pair of the longitudinally extending walls, wherein the pair of longitudinally extending walls includes a first wall substantially thicker than a second wall.

BRIEF DESCRIPTION OF DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

The present invention will be better understood upon reading the following detailed description of embodiments of aspects thereof in connection with the figures.

The invention provides for improved crosstalk characteristics by introducing a cable spline which retains a wire in a channel and reduces attenuation due to loss tangent, while allowing for a greater separation between twisted pairs which have stronger electromagnetic coupling. The invention also provides for a cable spline assembly have the properties described above, and which additionally provides for more shielding between strongly coupled twisted pairs as well as easier installation of the cable.

Figure 1:
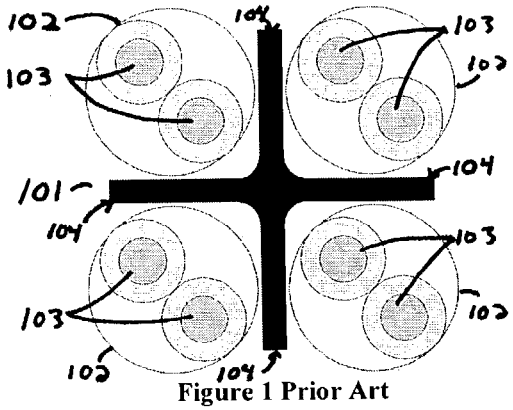
Figure 1 Prior Art
FIG. 1 is a cross-section of a prior art cable including an interior support.
Figure 2:
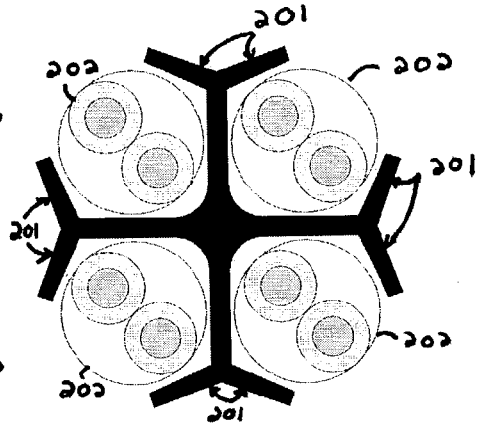
Figure 2 Prior Art
FIG. 2 is a cross-section of another prior art cable including an interior support.
Figure 3:
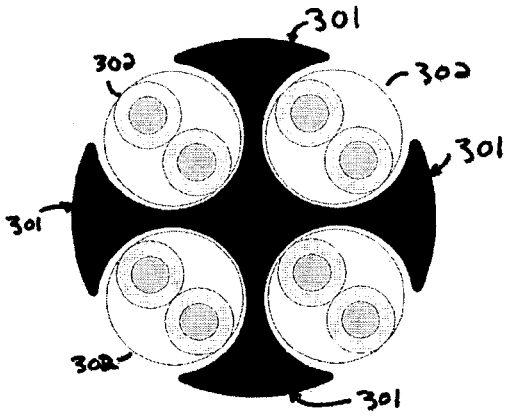
Figure 3 Prior Art
FIG. 3 is a cross-section of yet another prior art cable including an interior support.
Figure 4:
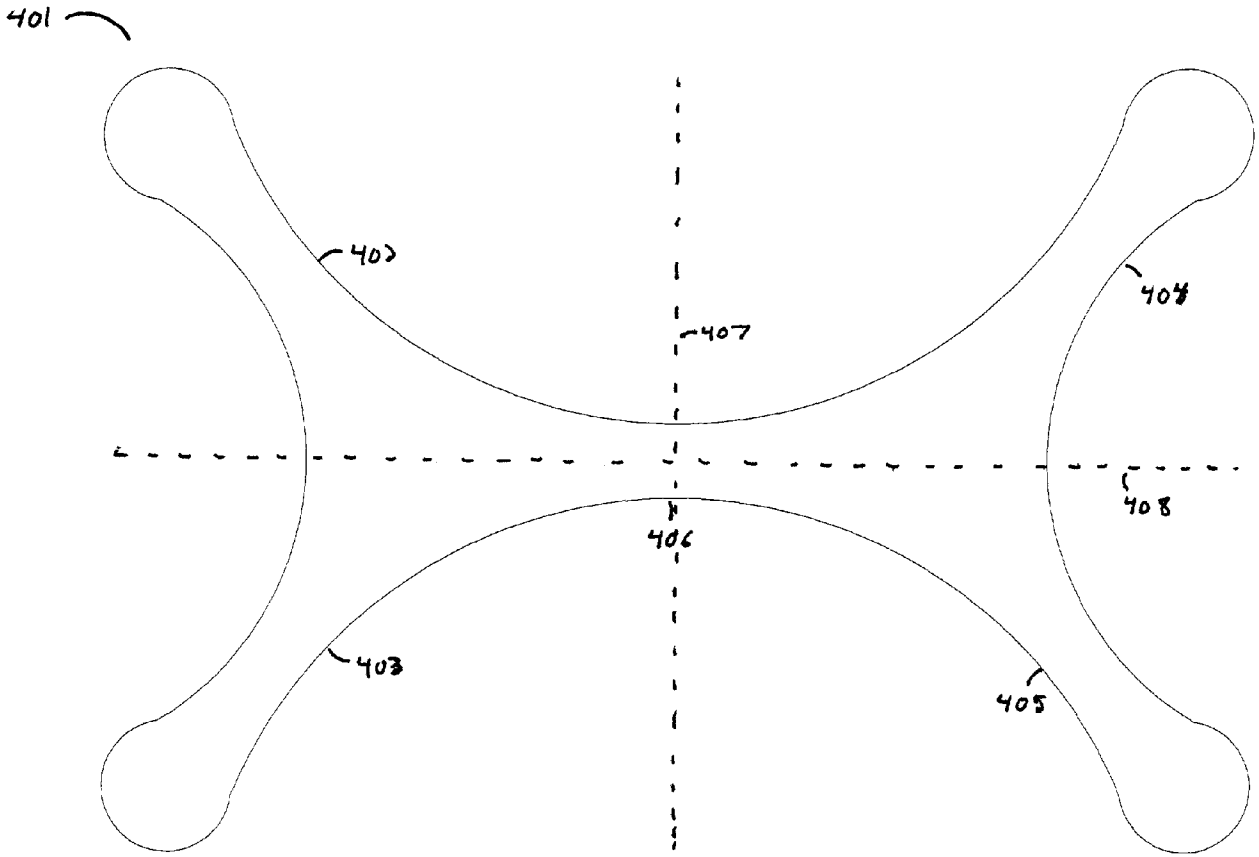
Fig. 4 Prior Art
FIG. 4 is a cross-section of an interior support of yet another prior art cable.
Figure 5:
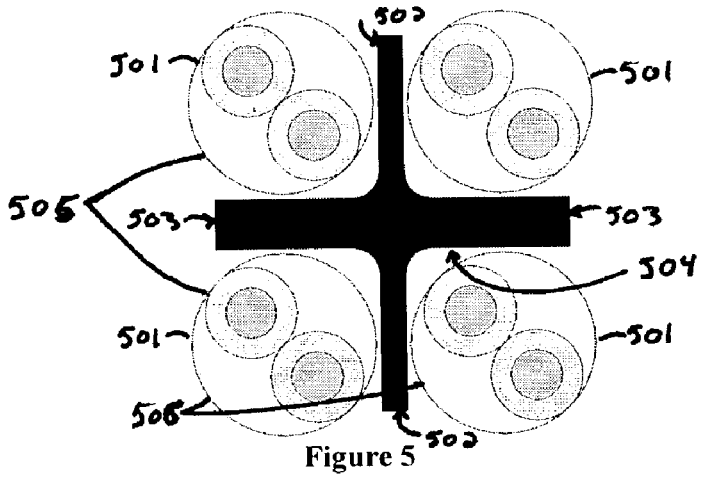
FIG. 5 is a cross-section of a cable according to one embodiment of the present invention.

FIG. 5 shows a cross-section of a cable and cable spline according to one embodiment of aspects of the present invention. The cable includes four twisted pair wires 501 separated from each other by the walls 502 and 503 of a cable spline 504. Each of the twisted pairs is held in a channel formed by two walls 502 and 503 of the cable spline, wherein one of the walls (503) forming the channel is thicker than the other (502). The structure of the cable spline of FIG. 5 allows a set of twisted pair cables 505 which tend to have high cross-talk, for example due to substantially similar twist-lay length, to be separated by a distance greater than another set 506 which is not as strongly coupled.

Figure 6:
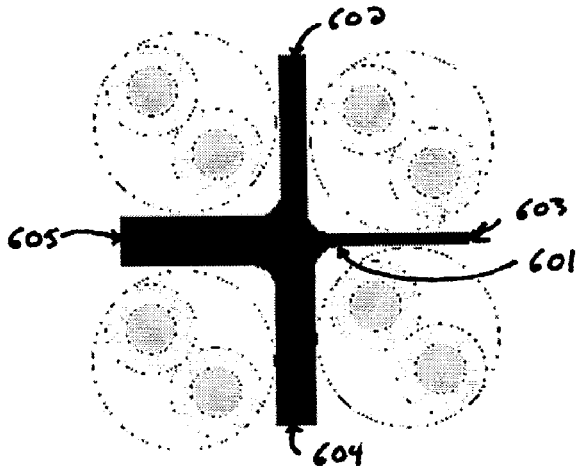
FIG. 6 is a cross-section of a cable according to another embodiment of the present invention.
Figure 7:
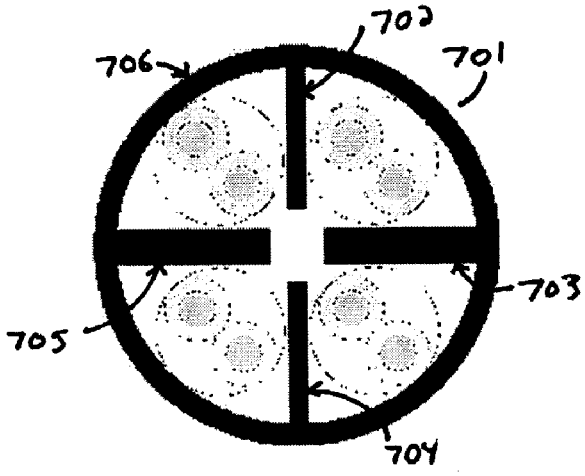
FIG. 7 is a cross-section of a cable according to another embodiment of the present invention.

FIGS. 6 and 7 show examples of two variations of the embodiment of the invention shown in FIG. 5. FIG. 6 shows a cross-section of a cable having a cable spline 601 which, like the spline of FIG. 5, has a plurality of channels wherein each channel is formed of two walls, one wall being thicker than the other. However, in FIG. 6, the four walls 602–605 of the spline each have a unique thickness. Thus, each of the channels of the spline of FIG. 6 is formed of two walls having unique thicknesses. The cable spline 601 of FIG. 6 offers the advantage of having four different thicknesses by which to separate twisted pair cables, depending on their relative degree of cross-talk. FIG. 7 depicts a cross-section of a cable having a cable spline separator similar to that of FIG. 5, but which is formed by walls 702–705 joined to a surrounding jacket 706 rather than joined along a central axis.

Figure 8:
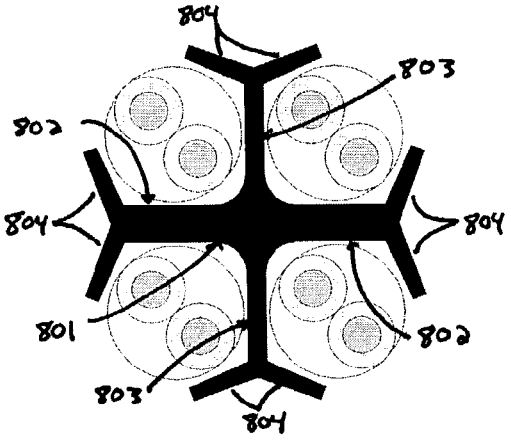
FIG. 8 is a cross-section of a cable according to another embodiment of the present invention.
Figure 9:
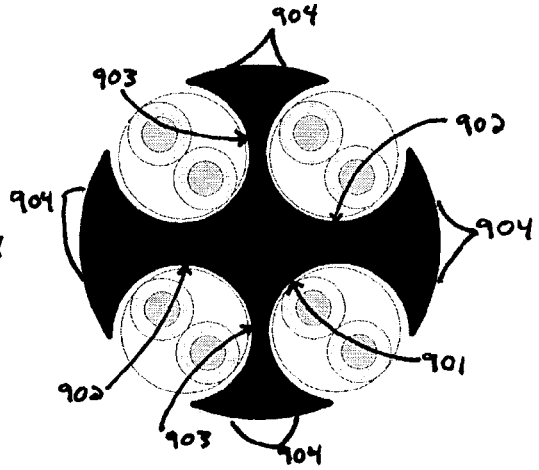
FIG. 9 is a cross-section of a cable according to another embodiment of the present invention.

FIGS. 8 and 9 show examples of two variations of the embodiment of the invention shown in FIG. 5. FIGS. 8 and 9 shows cross-sections of cables having cable splines 801 and 901 which, like the spline of FIG. 5, have a plurality of channels wherein each channel is formed of two walls, one wall (802 and 902) being thicker than the other (803 and 903). In addition, the cable of FIGS. 8 and 9 feature walls having peripheral edges 804 and 904 which are flanged. By flanged edges we mean that the peripheral edges 804 and 904 of the walls extend in both directions sufficiently far around the adjacent two longitudinally extending channels to retain a twisted pair cable in a stable position, but leave an opening through which twisted pairs of insulated conductors can be inserted during the manufacturing process. The flanged edges 804 and 904 may have several beneficial effects; for example, they serve to retain the twisted pairs within the channels more securely and also may reduce attenuation due to loss-tangent caused by contact of the twisted pairs with the jacketing material of the cable.

FIG. 8 shows the walls 802 and 803 having flanged edges 804 forming a channel in which the transverse cross-section of the longitudinally extending channel is a substantially polygonal void. FIG. 9 shows the walls 902 and 903 having flanged edges 904 which form a channel having a substantially circular cross-section. These variations demonstrate modifications of the present invention which may be made to suit particular uses. For example, the spline 901 of FIG. 9 may offer more insulation and protection for twisted pairs, while the spline 801 of FIG. 8 may use less material in its construction and thus prove more economical. Modifications such as these are intended to fall within the scope of the claimed invention.

Figure 10:
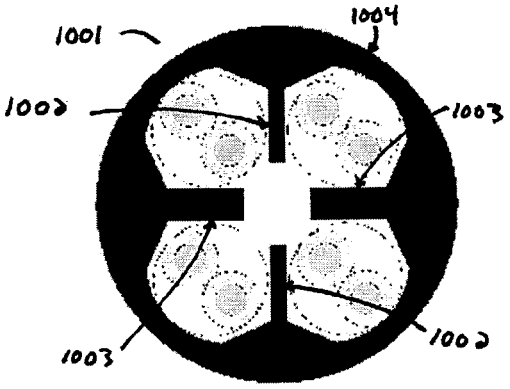
FIG. 10 is a cross-section of a cable according to another embodiment of the present invention.
Figure 11:
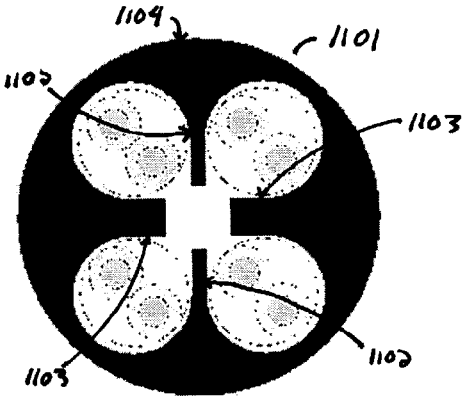
FIG. 11 is a cross-section of a cable according to another embodiment of the present invention.

FIGS. 10 and 11 depict variations of the embodiments of the invention shown in FIGS. 8 and 9 respectively. FIGS. 10 depicts a cable spline 1001 having channels which, like those of FIG. 8, have a polygonal cross section; likewise, FIG. 11 depicts a cable spline 1101 having channels which have a circular cross-section similar to those in the embodiment shown in FIG. 9. However, the cable splines of FIGS. 10 and 11 are formed by walls 1002, 1003, 1102, and 1103 attached to respective surrounding jackets 1004 and 1104, while those of FIGS. 8 and 9 are joined along a respective central axis. As discussed in connection with FIGS. 8 and 9, the various cross-sections may afford different advantages in retaining the cable in place. In addition, having walls which are peripherally added to a jacket may offer advantages in manufacturing such as reducing the number of steps or components needed for a cable.

Figure 12:
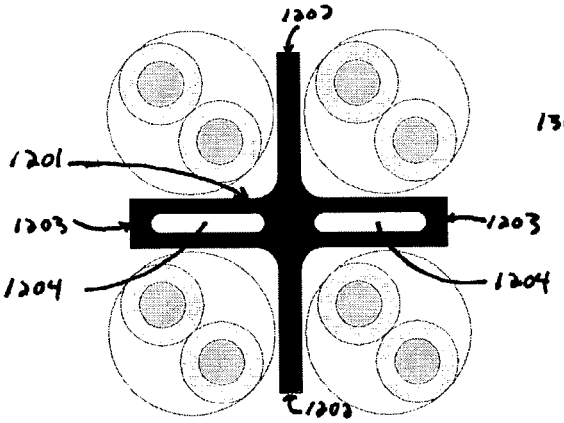
FIG. 12 is a cross-section of a cable according to another embodiment of the present invention.

FIG. 12 shows a cross-section of a cable and a cable spline according to another embodiment of the invention. Like the previous embodiment shown in FIG. 5, FIG. 12 shows a cable spline 1201 having channels or grooves for holding twisted pairs where each channel is formed by a first wall 1202 and a second, thicker wall 1203. In addition, the walls 1203 of the spline in FIG. 12 include hollow regions 1204 formed internally. These hollow regions may be empty or may be filled with various materials. For example, a hollow region may be empty in order to reduce the cost of producing the spline, or to reduce the dielectric constant of insulating materials. Likewise, a hollow may be filled with an insulating material or materials designed to reduce the electromagnetic coupling between twisted pairs. For example, the hollows may be filled with a dielectric material, a conductive material, or a magnetically active material. These and other materials are discussed in detail later in this description.

Figure 13:
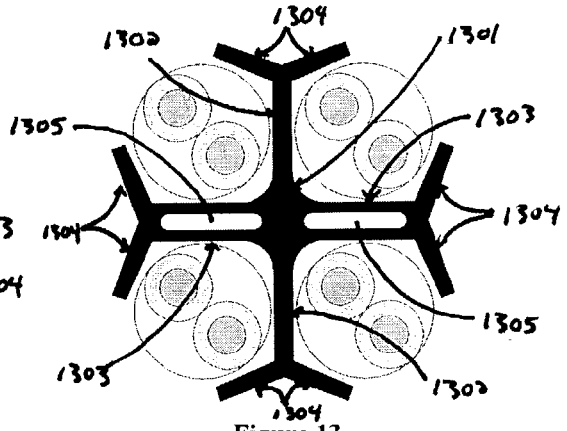
FIG. 13 is a cross-section of a cable according to another embodiment of the present invention.
Figure 14:
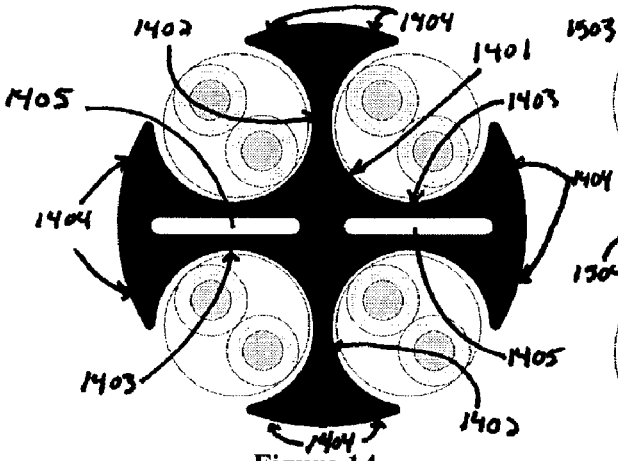
FIG. 14 is a cross-section of a cable according to another embodiment of the present invention.

FIGS. 13 and 14 show variations and combinations of the previously mentioned embodiment. FIG. 13 shows a cable spline 1301 according to the present invention having channels defined by two walls 1302 and 1303, one (1303) thicker than the other (1302), in which the walls have flanged edges 1304 which form a substantially polygonal cross-section and hollow regions 1305 which are internal to the walls of the spline. Likewise, the spline 1401 the cable in FIG. 14 has walls 1402 and 1403 with flanged edges 1404 forming a substantially circular cross section as well as internal hollow regions 1405 formed internal to walls 1403. While not shown, it is to be understood that similar hollow regions could likewise be incorporated into those embodiments of the invention which include walls attached to a jacket rather than joined along a central axis.

Figure 15:
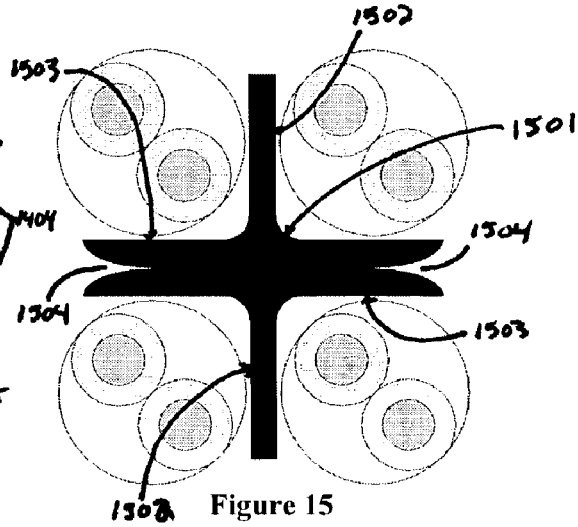
FIG. 15 is a cross-section of a cable according to another embodiment of the present invention.
Figure 16:
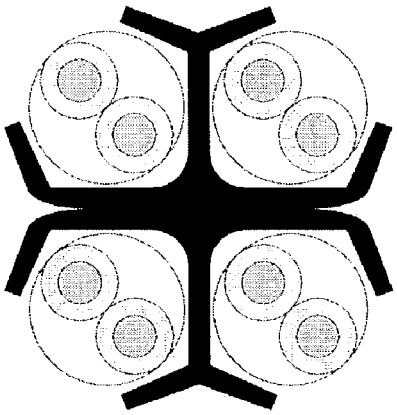
FIG. 16 is a cross-section of a cable according to another embodiment of the present invention.
Figure 17:
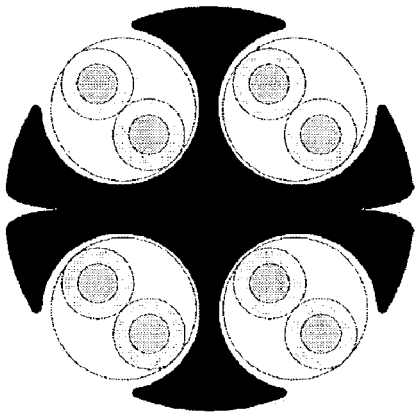
FIG. 17 is a cross-section of a cable according to another embodiment of the present invention.

Yet another embodiment of the invention is shown in FIG. 15. The cable spline 1501 of FIG. 15 features channels formed by two walls 1502 and 1503 of which one wall 1503 is thicker, and additionally contains bifurcations 1504 in the distal edges of the spline walls 1503. Bifurcation, here, meaning a division in the material of the walls such that the walls having bifurcations are formed of two distinct parts in the bifurcation area. However, bifurcated walls may be of parallel parts, unlike flanged walls as described above. These bifurcations 1504 may improve the performance or cost of the cable by, for example, improving the flexibility of the walls of the spline or reducing the amount of material needed to produce the cable spline. FIGS. 16 and 17 show the additional bifurcation feature of FIG. 15 in combination with the various examples of flanged edges which have been previously discussed as a few examples of potential combinations of the features discussed thus far.

Figure 18:
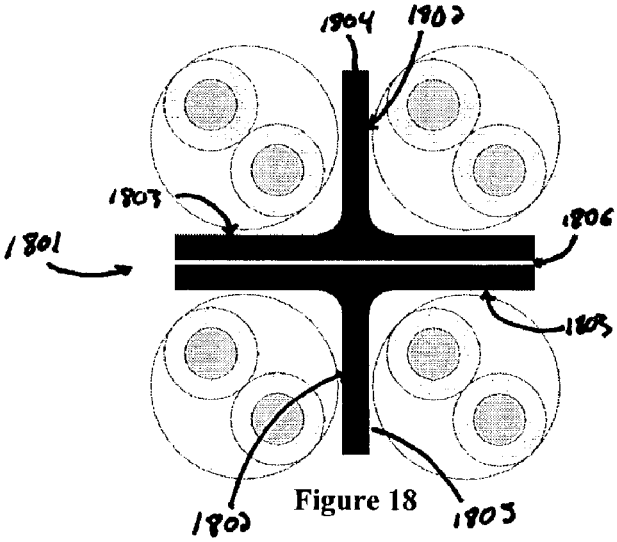
FIG. 18 is a cross-section of a cable according to another embodiment of the present invention.

Another embodiment of the invention is shown in FIG. 18. The spline assembly 1801 of FIG. 18, as discussed in connection with the previous embodiments, has channels for holding twisted pairs, each channel being defined by a first wall 1802 and a second, thicker wall 1803. The spline assembly comprises two sub-splines 1804 and 1805 having T-shaped cross-sections. In FIG. 18, the sub-spines have surfaces that face one another to define a space or gap 1806 which completely separates the two sub-spines. Preferably, the sub-splines are oriented such that the thick walls of each sub-spine are adjacent to the gap, but alternatively the opening could be along any of the walls of the spline assembly.

The spine assembly of FIG. 18 offers several advantages over cable splines that have been previously known. For example, it allows for greater mobility of the data cable, thus rendering installation of the cable easier. Additionally, the spline assembly allows for further insulation of twisted pairs by using shielding material in the gap 1806 between the two sub-splines 1804 and 1805 having T-shaped cross-sections. Examples of such materials are disclosed later in the specification in detail.

Figure 19:
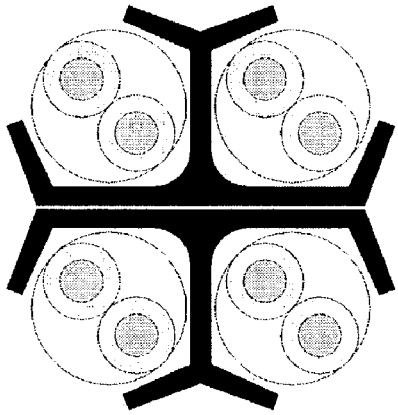
FIG. 19 is a cross-section of a cable according to another embodiment of the present invention.
Figure 20:
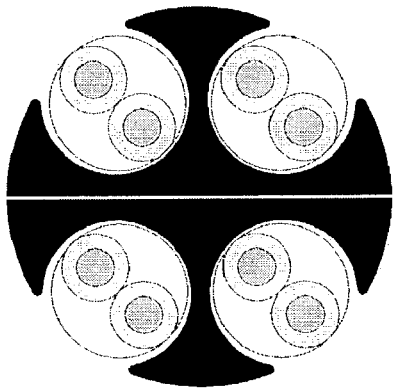
FIG. 20 is a cross-section of a cable according to another embodiment of the present invention.

FIGS. 19 and 20 show spline assemblies of the present invention incorporating the flanged edge variations previously discussed.

Figure 21:
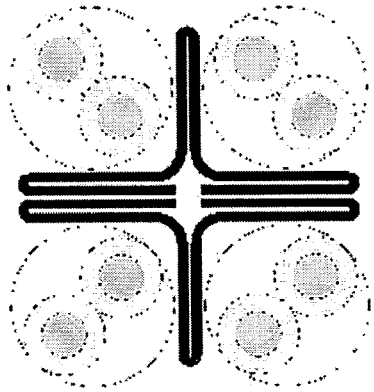
FIG. 21 is a cross-section of a cable according to another embodiment of the present invention.

In addition to the arrangements discussed above, the subsplines having T-shaped cross-sections may also be constructed of folded layers of shielding tape. An example of such a spline-assembly is shown in FIG. 21. Such a spline assembly may offer advantages in cost and may also be easier to manufacture. Examples of suitable tape and shielding layers are discussed in more detail below.

Figure 22:
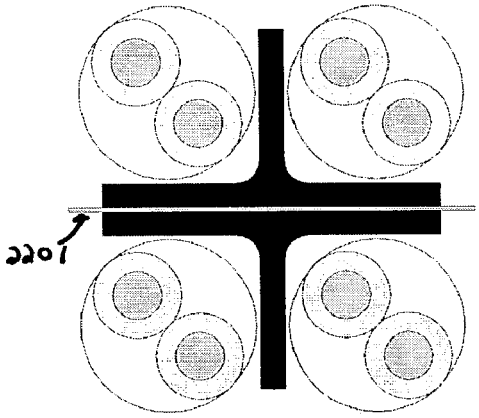
FIG. 22 is a cross-section of a cable according to another embodiment of the present invention.
Figure 23:
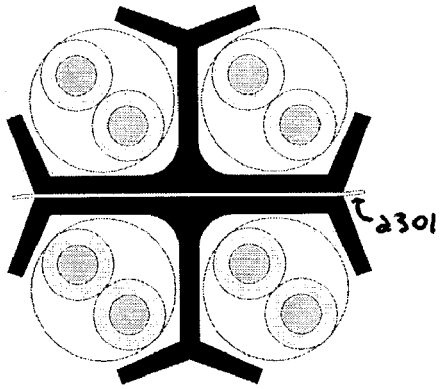
FIG. 23 is a cross-section of a cable according to another embodiment of the present invention.
Figure 24:
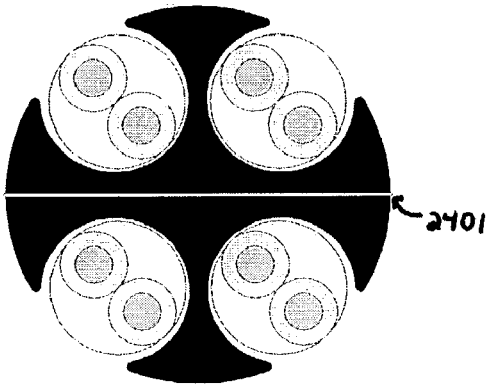
FIG. 24 is a cross-section of a cable according to another embodiment of the present invention.

FIGS. 22, 23, and 24 show several of the spline assemblies discussed above, additionally comprising a layer of shielding 2201, 2301, and 2401 separating the two sub-splines. This shielding may be constructed of a variety of materials. Examples of these materials will be discussed below.

Figure 25:
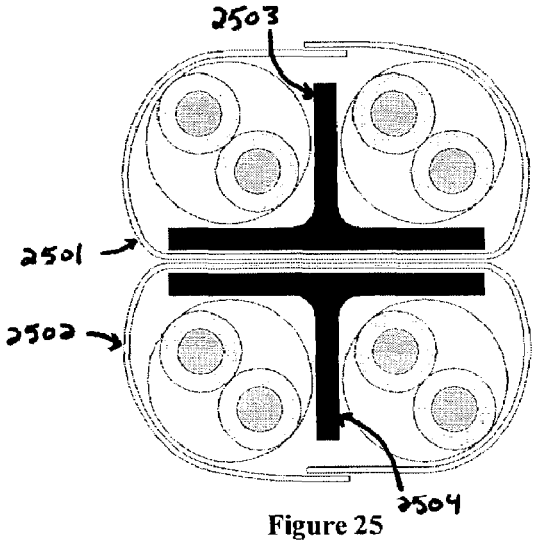
FIG. 25 is a cross-section of a cable according to another embodiment of the present invention.
Figure 26:
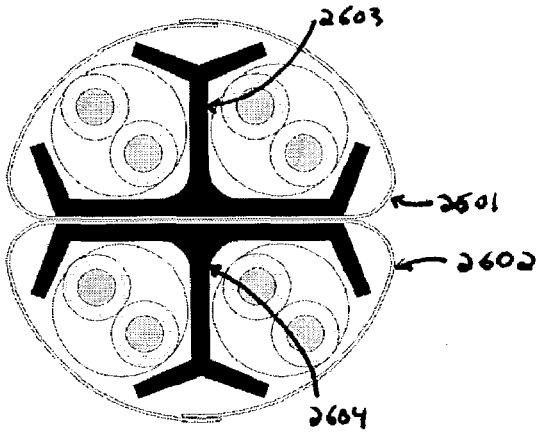
FIG. 26 is a cross-section of a cable according to another embodiment of the present invention.
Figure 27:
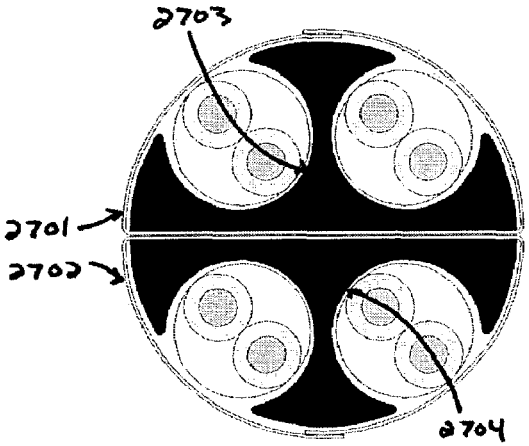
FIG. 27 is a cross-section of a cable according to another embodiment of the present invention.

In addition to using a single layer of shielding to separate and insulate the two sub-splines having T-shaped cross-sections, other shielding arrangements are possible. FIGS. 25–27 show cable spline assemblies such as those discussed above in which two layers of shielding (2501, 2502, 2601, 2602, 2701, and 2702) are arranged in between the two sub-splines (2503, 2504, 2603, 2604, 2703, and 2704), each sub-spine further being enclosed by one of the layers. This arrangement may offer several advantages. For example, it may offer additional insulation to prevent or reduce the electromagnetic coupling between twisted pairs held in different sub-splines.

Figure 28:
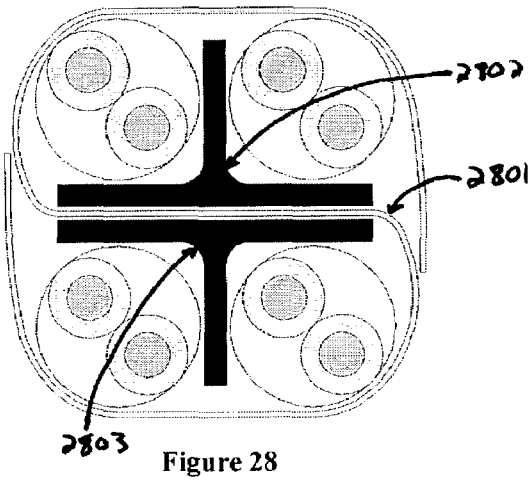
FIG. 28 is a cross-section of a cable according to another embodiment of the present invention.
Figure 29:
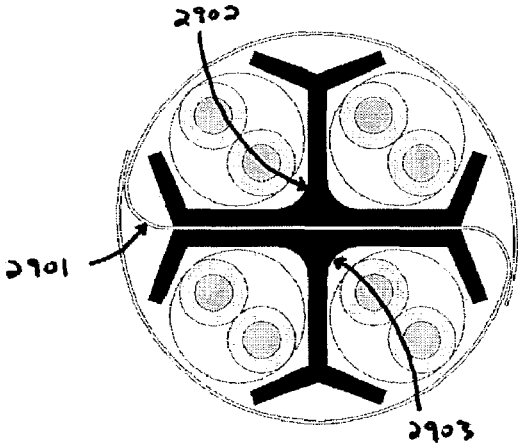
FIG. 29 is a cross-section of a cable according to another embodiment of the present invention.
Figure 30:
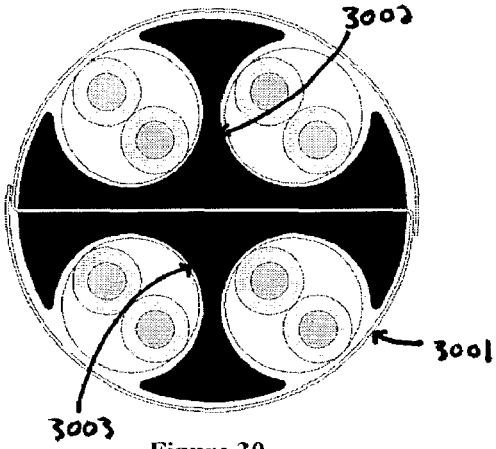
FIG. 30 is a cross-section of a cable according to another embodiment of the present invention.

Another possible shielding arrangement for use with the invention is depicted in FIGS. 28–30. In these embodiments, a single layer of shielding (2801, 2901, and 3001) may be used to separate and enclose the sub-splines having a T-shaped cross-section (2802, 2803, 2902, 2903, 3002, and 3003) by using an S-shaped wrapping. Such an arrangement may offer the protection and insulation of the embodiments described in FIGS. 25–27, while additionally using less shielding material or a less complex manufacturing process.

According to the present invention, many different material variations are possible in each of the embodiments previously discussed.

The spline used in each of the foregoing embodiments may be formed of variety of different materials. In general, it is desirable to use a material which has a low loss tangent. Suitable material include polyolefins such as polyethylene or polypropylene, as well as copolymers of each of those materials. Additionally, the material used in the construction of the cable spline may include fire-retardant additives such as chlorinated or brominated additives with antimony oxide or aluminum or magnesium hydroxides. Other examples of materials which may be used include low dielectric loss fluoropolymers such as fluorinated ethylene propylene (FEP) or ethylene-chlorotrifluoro-ethylene (such as VATAR™, produced by Ausimont). To reduce the use of material and further reduce dielectric loss, or allow the use of higher loss materials, the materials may be foamed. Foamed material can further improve overall attenuation and both attenuation and impedance roughness because air or other foaming gasses such as nitrogen generally have lower dielectric loss than the unfoamed material.

As mentioned previously, the cables and cable splines of the present invention may contain additional materials to improve isolation and cable performance. For example, conductive materials may be deposited inside or on the surface of the splines. Materials deposited inside the splines may be distributed throughout the spline, or may fill a hollow region such as those embodiments described in connection with FIGS. 8–10. Metallic depositions can be made on the spline either electrolytically or using a current-less process. Suitable materials are, for instance, nickel, iron and copper. The first two materials having the added advantage of superior shielding effectiveness for a given coating thickness due to the relatively high permeability of those materials.

If the spline is covered with or formed of an electrically conductive material, preferably a material also having a high permeability, then the shielding effectiveness of the spline according to the present invention is greater than previously known splines not having a conductive coating. The conductive surfaces of the spline may be longitudinally in contact with a surrounding foil shield. In this way the spline and the foil shield combine to form shielded sectored compartments for each twisted pair. In fact, if the shielding material on or forming the spline has a sufficient thickness to provide shielding equivalent to the shielding effectiveness of the surrounding foil shield, then performance close to STP cable can be attained. Thus, cables can be designed which have geometric characteristics similar or identical to high performance FTP cable while having substantially the electric performance of STP cable.

The foregoing cable employing a conductively coated spline is advantageous in another, unexpected way. By shielding the twisted pairs from the material of the spline, the inventive construction of this embodiment may render the loss tangent of the spline material unimportant. Therefore, the material of the spline may be chosen without regard for its loss tangent, but rather with regard to such considerations as cost, flammability, smoke production and flame spread.

Cable splines including suitable conductive shielding materials can be produced a variety of ways. The surface of a non-conductive polymeric spline can be rendered conductive by using conductive coatings, which could also be polymeric. Another possibility is to use a sufficiently conductive polymer to construct the spline.

One process which can produce a suitable coating is electrolytic metallization. However, the penetration of the coating into the grooves or channels of the spline during production can be difficult. This process tends to produce an accumulation of deposited metal at the tips of the spline arms or flanges. Another possibility would be to deposit the metal in a current less process. The most common metals used for these processes are nickel and copper. Alternatively, the cable spline could be coated by vapor deposition.

As mentioned above, conductivity can be achieved by use of conductive materials for the cable spline material. Moreover, other coatings can be combined with a spline formed of a ferrite-loaded polymer, in order to decrease pair-to-pair coupling. Such a material provides magnetic properties which improve the cross talk isolation. Moreover, if such a spline is additionally metalized at the surface, then the metal coating can be substantially smaller than in the previously described designs.

The shielding layers used in some of the embodiments of the invention may also be constructed of a variety of materials. Examples of these materials include metal foil, metal coated polymer tapes, braided wire coverings, etc.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. A data cable, comprising:

a plurality of data transmission media including first, second, third and fourth data transmission media; and a separator spline positioned between the data transmission media, the separator spline including:

a plurality of longitudinally extending walls joined along a central axis of the spline; and a plurality of longitudinally extending channels, each longitudinally extending channel defined by a pair of the longitudinally extending walls;

wherein the pair of longitudinally extending walls includes a first wall substantially thicker than a second wall;

wherein, absent the separator spline, the first and second data transmission media would be more strongly coupled to one another than are the first and third data transmission media; and wherein the plurality of data transmission media and the separator spline are arranged such that the first wall lies between the first and second data transmission media and the second wall lies between the first and third data transmission media.

2. The spline of claim 1, wherein the pair of longitudinally extending walls include flanged edges.

3. The spline of claim 2, wherein the flanged edges of the pair of longitudinally extending walls extend sufficiently far around the longitudinally extending channel defined by the pair of longitudinally extending walls to retain a twisted pair cable lying therein in a stable position.

4. The spline of claim 3, wherein a transverse cross-section of each longitudinally extending channel is a substantially polygonal void.

5. The spline of claim 3, wherein a transverse cross-section of each longitudinally extending channel is a substantially circular void.

6. The spline of claim 1, wherein the first wall includes a surface defining an internal hollow region surrounded by the first wall.

7. The spline of claim 6, wherein a longitudinally extending wall has a flanged edge.

8. The spline of claim 6, wherein the pair of longitudinally extending walls include flanged edges.

9. The spline of claim 8, wherein the flanged edges of the pair of longitudinally extending walls extend sufficiently far around the longitudinally extending channel defined by the pair to retain a twisted pair cable lying therein in a stable position.

10. The data cable of claim 1, wherein the plurality of longitudinally extending walls comprise a conductive material.

11. The data cable of claim 10, wherein the conductive material is disposed on the surface of the plurality of longitudinally extending walls.

12. The data cable of claim 10, wherein the conductive material is embedded inside the plurality of longitudinally extending walls.

13. A data cable separator spline, comprising:

a plurality of longitudinally extending walls joined along a central axis of the spline; and a plurality of longitudinally extending channels, each longitudinally extending channel defined by a pair of the longitudinally extending walls;

wherein the pair of longitudinally extending walls includes a first wall substantially thicker than a second wall; and wherein the separator spline is substantially non-conductive.

14. A high performance data cable comprising:

a plurality of twisted pairs of insulated conductors including a first twisted pair, a second twisted pair, and a third twisted pair;

a cable separator spline having:

a plurality of longitudinally extending walls joined along a central axis of the spline; and a plurality of longitudinally extending channels, each longitudinally extending channel defined by a pair of the longitudinally extending walls;

wherein the pair of longitudinally extending walls includes a first wall substantially thicker than a second wall;

wherein, absent the cable separator spline, coupling between the first pair and the third pair would be stronger than coupling between the first pair and the second pair; and wherein the first wall of the cable separator spline is positioned so as to separate the first twisted pair from the third twisted pair.

15. The high performance data cable of claim 14, wherein the plurality of longitudinally extending walls comprise:

a conductive material.

16. The high performance data cable of claim 15, wherein the conductive material is disposed on the surface of the plurality of longitudinally extending walls.

17. The high performance data cable of claim 15, wherein the conductive material is embedded inside the plurality of longitudinally extending walls.

18. The high performance data cable of claim 14, wherein the plurality of longitudinally extending walls comprise:

a magnetic shield material.

19. The high performance data cable of claim 18, wherein the magnetic shield material is disposed on the surface of the plurality of longitudinally extending walls.

20. The high performance data cable of claim 18, wherein the magnetic shield material is embedded inside the plurality of longitudinally extending walls.

21. The high performance data cable of claim 18, wherein the magnetic shield material comprises ferrite.

22. The high performance data cable of claim 14, wherein the first wall of the cable separator spline includes a surface defining an internal hollow region surrounded by the first wall.

23. The high performance data cable of claim 22, wherein a longitudinally extending wall of the cable separator spline has a bifurcated edge.

24. The high performance data cable of claim 22, wherein a longitudinally extending wall of the cable separator spline has a flanged edge.

25. The high performance data cable of claim 24, wherein a longitudinally extending wall of the cable separator spline has a bifurcated edge.

26. The high performance data cable of claim 24, wherein the pair of longitudinally extending walls of the cable separator spline include flanged edges.

27. The high performance data cable of claim 26, wherein the flanged edges of the pair of longitudinally extending walls extend sufficiently far around the longitudinally extending channel defined by the pair to retain a twisted pair cable lying therein in a stable position.

28. The high performance data cable of claim 14, wherein a longitudinally extending wall of the data cable has a flanged edge.

29. The high performance data cable of claim 28, wherein the pair of longitudinally extending walls include flanged edges.

30. The high performance data cable of claim 29, wherein the flanged edges extend sufficiently far around the longitudinally extending channel defined by the pair to retain a twisted pair cable lying therein in a stable position.

31. A high performance data cable comprising:

a plurality of twisted pairs of insulated conductors including a first twisted pair and a second twisted pair;

a jacket;

a plurality of longitudinally extending radial walls;

a plurality of longitudinally extending channels, each longitudinally extending channel defined by a pair of the longitudinally extending radial walls;

wherein the pair of longitudinally extending radial walls includes a first wall substantially thicker than a second wall;

wherein, absent the plurality of longitudinally extending radial walls, coupling between the first twisted pair and the second twist pair would be greater than coupling between the first twisted pair and any other twisted pairs of the plurality of twisted pairs of insulated conductors; and wherein the plurality of twisted pairs of insulated conductors are arranged within the cable such that the first wall separates the first twisted pair from the second twisted pair.

32. The cable separator of claim 31, further comprising a jacket surrounding the cable, and wherein the walls are joined to the jacket on an inner surface thereof.

33. The cable separator of claim 32, wherein a longitudinally extending wall has a bifurcated edge.

34. The cable separator of claim 32, wherein a longitudinally extending wall has a flanged edge.

35. The cable separator of claim 34, wherein a transverse cross-section of each longitudinally extending channel is a substantially polygonal void.

36. The cable separator of claim 34, wherein a transverse cross-section of each longitudinally extending channel is a substantially circular void.

37. The cable separator of claim 32, wherein the first wall includes a surface defining an internal hollow region surrounded by the first wall.

38. A data cable, comprising:

a plurality of data transmission media; and a separator positioned between the plurality of data transmission media, the separator including:

a plurality of longitudinally extending radial walls; and a plurality of longitudinally extending channels, each longitudinally extending channel defined by a pair of the longitudinally extending radial walls;

wherein the pair of longitudinally extending radial walls includes a first wall substantially thicker than a second wall; and wherein ones of the plurality of data transmission media having high crosstalk, absent the plurality of longitudinally extending radial walls, are separated from one another by the first wall.

39. The data cable of claim 38, wherein the plurality of longitudinally extending walls comprise a conductive material.

40. The data cable of claim 39, wherein the conductive material is disposed on the surface of the plurality of longitudinally extending walls.

41. The data cable of claim 39, wherein the conductive material is embedded inside the plurality of longitudinally extending walls.

42. A data cable separator, comprising:

a plurality of longitudinally extending radial walls;

a plurality of longitudinally extending channels, each longitudinally extending channel defined by a pair of the longitudinally extending radial walls; and a conductive material disposed on the outer surface of all of the plurality of longitudinally extending radial walls;

wherein the pair of longitudinally extending radial walls includes a first wall substantially thicker than a second wall.

43. The data cable separator of claim 42, wherein the plurality of longitudinally extending walls comprise a magnetic shield material.

44. The data cable separator of claim 43, wherein the magnetic shield material is embedded inside the plurality of longitudinally extending walls.

45. The data cable separator of claim 43, wherein the magnetic shield material comprises ferrite.

46. A data communications cable, comprising:

a separator spline that includes a plurality of longitudinally extending walls joined along a central axis of the spline, and a plurality of longitudinally extending channels, each longitudinally extending channel defined by a pair of the longitudinally extending walls;

a plurality of twisted pairs of insulated conductors;

wherein the pair of longitudinally extending walls includes a first wall substantially thicker than a second wall;

wherein the separator spline and the plurality of twisted pairs are arranged such that a first set of said twisted pairs having high crosstalk, absent the separator spline, are separated from one another by the first wall;

wherein a second set of said twisted pairs having lower crosstalk than the first set, absent the separator spline, are separated from one another by the second wall; and wherein the plurality of longitudinally extending walls are each defined by a pair of parallel surfaces.

47. The spline of claim 46, wherein the plurality of longitudinally extending walls are each substantially solid.

48. A data communications cable comprising:

a plurality of twisted pairs of insulated conductors including a first twisted pair, a second twisted pair, a third twisted pair and a fourth twisted pair;

wherein inherent crosstalk between the first twisted pair and the third twisted pair is greater than inherent crosstalk between the first twisted pair and the second twisted pair;

wherein the first twisted pair is maintained spaced apart from the second twisted pair along a length of the data communications cable by a first spacing;

wherein the third twisted pair is maintained spaced apart from the fourth twisted pair along the length of the data communications cable by a second spacing that is substantially similar to the first spacing;

wherein the first twisted pair is maintained spaced apart from the third twisted pair along the length of the data communications cable by a third spacing that is substantially larger than the first and second spacings; and wherein the second twisted pair is maintained spaced apart from the fourth twisted pair along the length of the data communications cable by a fourth spacing that is substantially similar to the third spacing.

* * * * *

UNITED STATES PATENT AND TRADEMARK OFFICE

CERTIFICATE OF CORRECTION

PATENT NO. : 7,196,271 B2
APPLICATION NO. : 10/378398
DATED : March 27, 2007
INVENTOR(S) : Jacques Cornibert et al.

It is certified that error appears in the above-identified patent and that said Letters Patent is hereby corrected as shown below:

In column 10, line 66, “spline” should read -- data cable --.
In column 11, line 1, “spline” should read -- data cable --.
In column 11, line 6 “spline” should read -- data cable --.
In column 11, line 9, “spline” should read -- data cable --.
In column 11, line 12, “spline” should read -- data cable --.
In column 11, line 15, “spline” should read -- data cable --.
In column 11, line 17, “spline” should read -- data cable --.
In column 11, line 19, “spline” should read -- data cable --.
In column 12, line 15, “cable separator” should read -- high performance data cable --.
In column 13, line 5, “cable separator” should read -- high performance data cable --.
In column 13, line 8, “cable separator” should read -- high performance data cable --.
In column 13, line 10, “cable separator” should read -- high performance data cable --.
In column 13, line 12, “cable separator” should read -- high performance data cable --.
In column 13, line 18, “cable separator” should read -- high performance data cable --.
In column 14, line 28 “spline” should read -- data communications cable --.

Signed and Sealed this

Third Day of July, 2007

JON W. DUDAS
*Director of the United States Patent and Trademark Office*